US006645000B2

(12) United States Patent
Sato et al.

(10) Patent No.: US 6,645,000 B2
(45) Date of Patent: Nov. 11, 2003

(54) MODULAR JACK

(75) Inventors: Satoshi Sato, Tokyo (JP); Akio Suzuki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/147,861

(22) Filed: May 20, 2002

(65) Prior Publication Data

US 2002/0177354 A1 Nov. 28, 2002

(30) Foreign Application Priority Data

May 28, 2001 (JP) ..... 2001-159057

(51) Int. Cl.[7] ..... H01R 3/00
(52) U.S. Cl. ..... 439/490
(58) Field of Search ..... 439/490, 676, 439/607, 609

(56) References Cited

U.S. PATENT DOCUMENTS 5,685,737 A * 11/1997 Morin et al. ..... 439/490
6,142,822 A * 11/2000 Wu ..... 439/490
6,217,371 B1 * 4/2001 Wu ..... 439/490
6,319,062 B1 * 11/2001 Ma et al. ..... 439/490
6,325,664 B1 * 12/2001 Someda et al. ..... 439/490
6,354,884 B1 * 3/2002 Yeh et al. ..... 439/490

* cited by examiner

*Primary Examiner*—Gary Paumen
(74) *Attorney, Agent, or Firm*—Kanesaka & Takeuchi

(57) ABSTRACT

The modular jack (21) comprises a housing (22) having side walls (30), a plurality of cavities (27, 28) provided at a front side of the housing (22), into which mating modular plugs are inserted, at least one groove (33, 34) provided in one of the side walls (30), and at least one LED (24, 25) fitted into the groove (33, 34) and accommodated in the side walls (30). Accordingly, the fixing work for LEDs (24, 25) is simplified and the manufacturing cost is minimized.

6 Claims, 4 Drawing Sheets

MODULAR JACK

BACKGROUND OF THE INVENTION

1. Field of the Invention

The present invention relates to a modular jack which engages with a modular plug and comprises light emitting diodes.

2. Description of the Related Art

A modular jack comprising light emitting diodes is well known for use in telephone equipment or a local area network (LAN). For example, such a modular jack is described in U.S. Pat. No. 5,685,737.

FIG. 5 shows a modular jack 1 that is described in U.S. Pat. No. 5,685,737. The modular jack comprises a housing 3 having a cavity 2, into which a modular plug (not shown) is inserted from the front side thereof, a predetermined number of terminals 4 arranged in parallel with each other in the cavity 2, and a pair of indicators 5 provided at the front side of the housing 3. Lower ends of the terminals 4 are connected to a circuit board (not shown).

A stepped groove 6 is provided at the center of the cavity 2 so as to be opposed to the terminals 4 and engageable with a lock section (not shown) of the modular plug. A pair of insertion grooves 7 are provided in the lower opposite sides of the cavity 2. A pair of guide projections 8 are provided on the inside of the insertion groove 7 in the insertion direction of the modular plug. A slit grooves 9 are formed on the rear side of the insertion groove 7.

The indicator 5 comprises an indicating section 11 having a pair of guide grooves 10 provided in opposite sides thereof and a pair of lead sections 12 extending rearwardly from the indicating section 11. The lead section 12 comprises a horizontal portion 13 and a vertical portion 14 extending downwardly from the horizontal portion 13 toward the circuit board. The guide groove 10 is engaged with the guide projection 8 and the lead section is engaged with the slit groove 9, holding the indicator 11 in the insertion groove 7 such that the indicating section 11 is visible from the front side.

When the modular plug (not shown) is inserted into the modular jack 1, one of indicators 5 (e.g. right-hand side indicator in FIG. 5) lights up to indicate that the modular jack 1 and the modular plug are electrically connected. While data is transmitted between the modular jack 1 and the modular plug, the other indicator 5 (e.g. left-hand side indicator in FIG. 5) lights up.

However, since the conventional modular jack requires the guide groove 10 provided on the opposite sides of the indicating section 11 of the indicator 5, the process is complex, and the indicator 5 sold on the market cannot be used, thus increasing the manufacturing cost.

In addition, since the indicators 5 are provided on lower opposite sides of the cavity 2 and on right- and left-hand sides of the groove 6, when the modular plug is inserted into the modular jack 1, the front side of the indicating section 11 is hidden by cables of the modular plug so that it can become invisible.

SUMMARY OF THE INVENTION

Accordingly, it is an object of the invention to provide a modular jack that minimizes the manufacturing cost and makes the indicator clearly visible.

According to the invention there is provided a modular jack which comprises a housing having side walls, a plurality of cavities provided at a front side of the housing, into which mating modular plugs are inserted, at least one groove provided in one of the side walls, and at least one light emitting diode (LED) fitted into the groove and accommodated in the side wall.

Preferably, the above groove has a holding section, in which the LED is press-fitted.

The modular jack may further comprise a shield plate provided outside the housing so as to press the LED to the housing.

The shield plate may have recesses for pressing the LED to the housing.

According to the invention, since the LED is fixed to the housing by inserting it into the groove, the fixing work for LED is simplified, and ordinary LED sold on the market is useable, which reduces the manufacturing cost. Also, since the LED is provided in one of the side walls of the housing, when the modular plug is inserted into the modular jack, the indicating section of the LED is not hidden by the cables of the modular plug and clearly visible.

DESCRIPTION OF THE PREFERRED EMBODIMENTS

Figure 1:
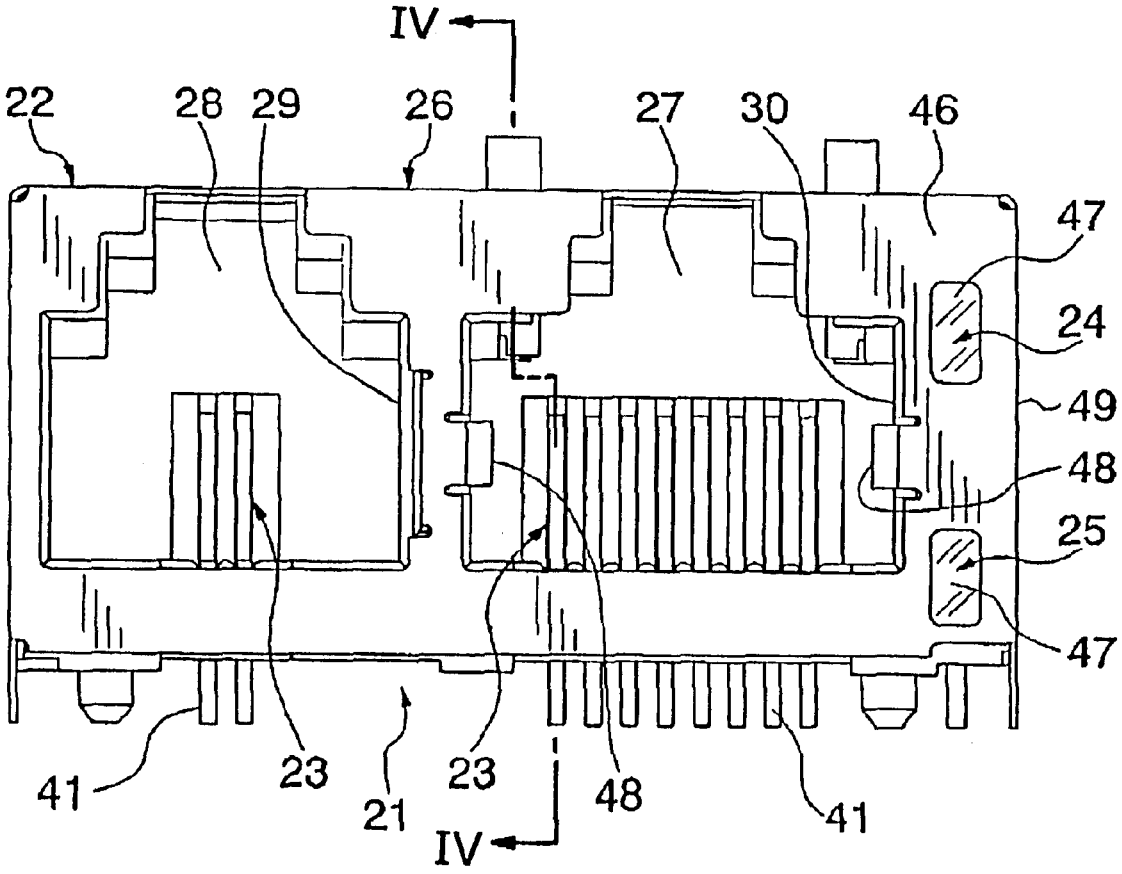
FIG. 1 is a front view of a modular jack according to an embodiment of the invention.
Figure 2:
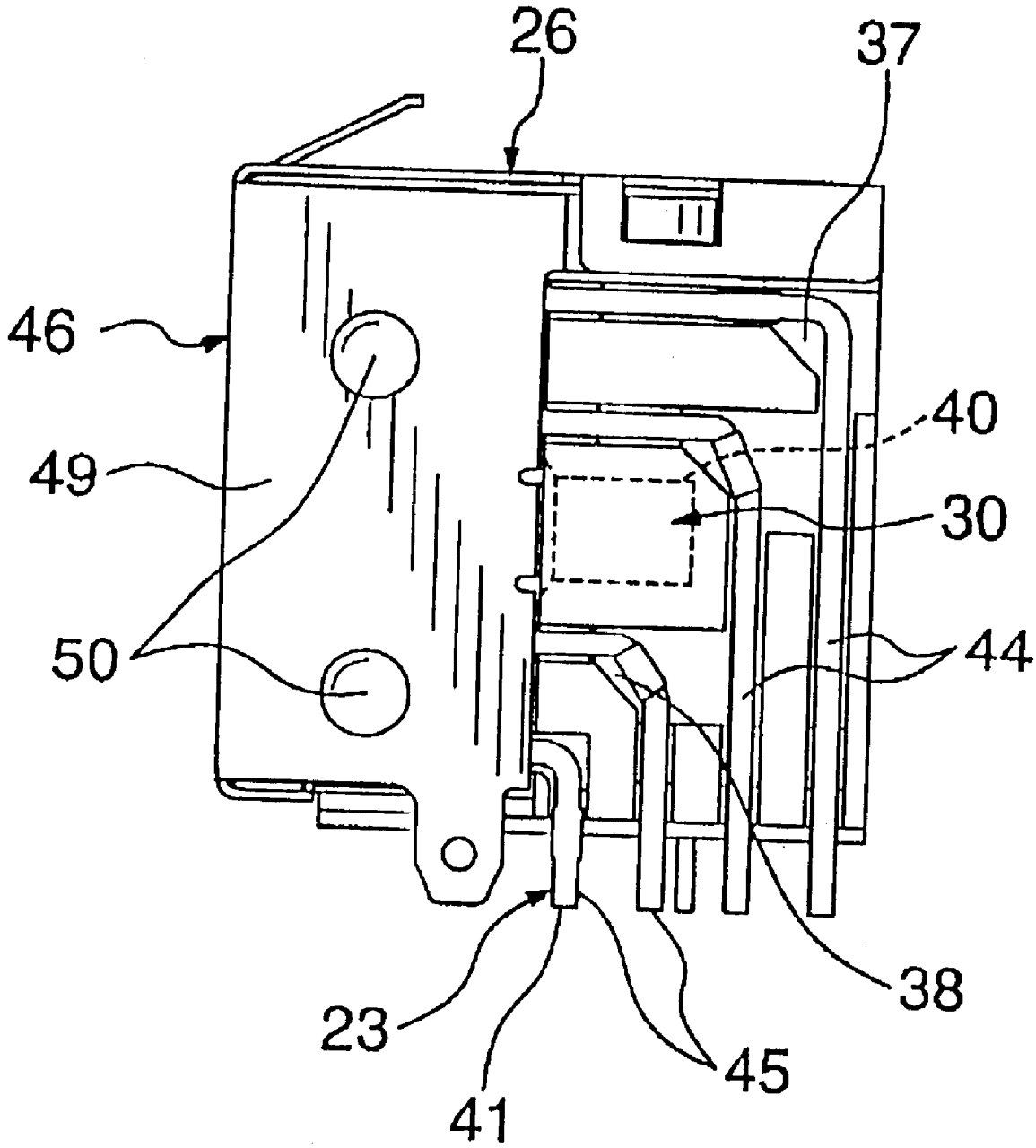
FIG. 2 is a side view of the modular jack.
Figure 3:
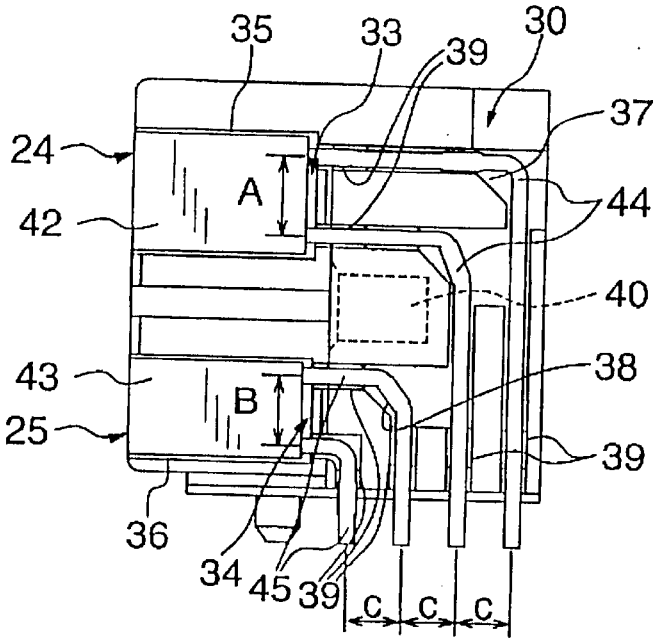
FIG. 3 is a side view of the modular jack without a shield plate.
Figure 4:
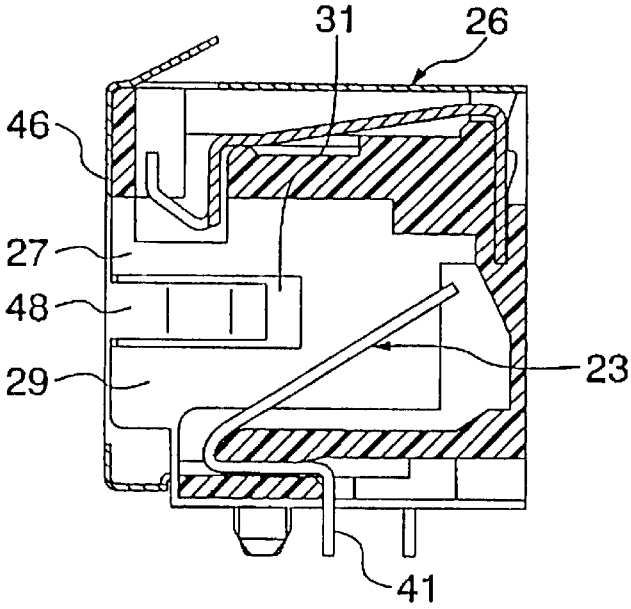
FIG. 4 is a sectional view taken along line IV-IV of FIG. 1.
Figure 5:
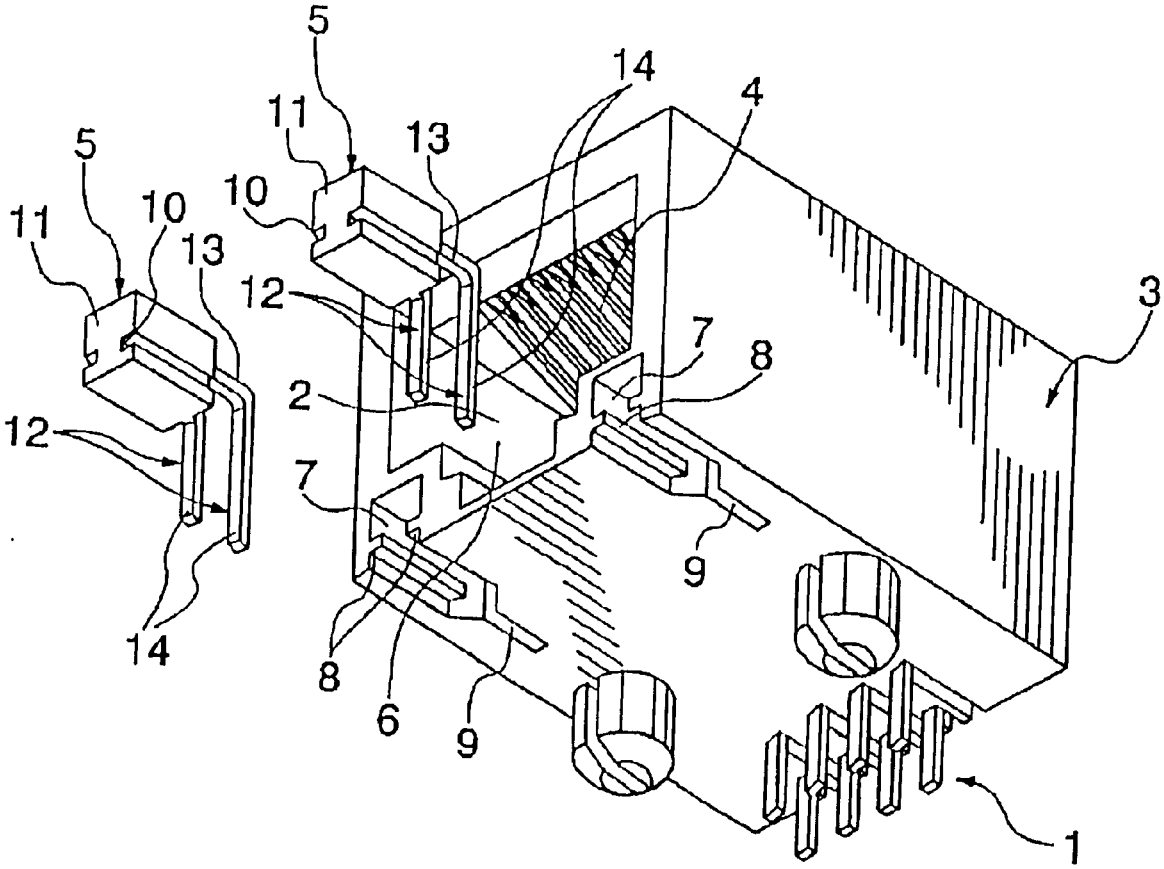
FIG. 5 is a perspective view of a conventional modular jack.

Embodiments of the invention will now be described with reference to the accompanying drawings.

FIGS. 1 to 4 show a modular jack 21 according to an embodiment of the invention. The modular jack 21 comprises an insulating housing 22, a plurality of terminals 23 provided in the housing 22, a pair of light emitting diodes (LED) 24 and 25 which are visible from the front side, and a shield plate 26 provided outside the housing 22.

A predetermined number of cavities (two cavities in FIG. 1) 27 and 28 are provided on the front side of the housing 22. A modular plug (not shown) for LAN is inserted into the cavity 27 and a modular plug (not shown) for MODEM is inserted into the cavity 28. A partition wall 29 is provided between the cavities 27 and 28. A clearance groove 31 is horizontally provided in the partition wall 29. Another clearance groove 31 is horizontally provided in the inside of a side wall 30 of the cavity 27. The partition wall 29 and the side wall 30 face each other so that the clearance grooves 31 of both the walls face each other. Grooves 33 and 34 are provided in the outside of the side wall 30 and engaged with the LEDs 24 and 25, respectively. The grooves 33 and 34 are provided at positions which are close to the clearance groove 31 but do not overlap with the clearance groove 31 so that the thickness and height of the side wall 30 can be minimized. The groove 33 has a front section 35 and two L-shaped rear sections 37 extending rearwardly from the front section 35. The groove 34 has a front section 36 and two L-shaped rear sections 38 extending rearwardly from the front section 36. The rear sections 37 and 38 are formed such that a predetermined number of portions (four portions in FIG. 3) are narrower than the other portions to form holding portions 39. A fixing groove 40 is provided between the grooves 33 and 34 so that a projection (not shown) of the shield plate 26 is press-fitted into the fixing groove 40, thus firmly fixing the shield plate 26 to the housing 22. The fixing groove 40 is provided at the position which faces the clearance groove 31 and is close to but do not overlap with the grooves 33 and 34 so that the thickness and height of the side wall 30 can be minimized.

A predetermined number of the terminals 23 is arranged in the cavities 27 and 28 (in FIG. 1, eight terminals in the cavity 27 and two terminals in the cavity 28). Lower ends 41 of the terminals 23 project downwardly from the bottom surface of the housing 22 to be electrically connected to a circuit board (not shown).

The LEDs 24 and 25 have indicating sections 42 and 43 provided on the front side thereof and lead sections 44 and 45 extending rearwardly from the indicating sections 42 and 43, respectively. The indicating sections 42 and 43 engage with the front sections 35 and 35 of the grooves 33 and 34, and the lead sections 44 and 45 are press-fitted to the rear sections 37 and 38 of the grooves 33 and 34. Thus, the LEDs 24 and 25 are held by the holding section 39 within the side wall 30 of the housing 22. The indicating section 42 of the LED 24 is green, and the interval (dimension A in FIG. 3) of the lead sections 44 of the LED 24 in the vicinity of the indicating section 42 is 2.54 mm. The indicator section 43 of the LED 25 is yellow, and the interval (dimension B in FIG. 3) of the lead section 45 of the LED 25 in the vicinity of the indicating section 42 is 2.29 mm. Both the LEDs 24 and 25 are sold in the market. In order to fix the LEDs 24 and 25 to the housing 22, it is satisfactory to press-fit the LEDs 24 and 25 in the grooves 33 and 34 after bending the lead sections of the LEDs 24 and 25 along the L-shaped rear sections 37 and 38 of the grooves 33 and 34. Consequently, the processing and fixing work is simplified. The lead sections 44 and 45 are fixed to the circuit board at equal intervals (dimension C in FIG. 3).

The shield plate 26 covers an upper surface, a front surface excluding the cavities 27 and 28 of the housing, and the front sections 35 and 36 of the grooves 33 and 34. The shield plate 26 has a pair of windows 47 in the front surface 46 thereof at positions corresponding to the indicating sections 42 and 43. The windows 47 are made smaller than the front face of the indicating sections 42 and 43. Accordingly, even if the indicating sections 42 and 43 have different sizes, appearance looks good by making the windows of the same size. Cantilevered engaging pieces 48 extend from the front surface 46 of the shield plate 26 along the groove 31. Top portions of the engaging pieces 48 project into the cavity 27 slightly. A side surface 49 of the shield plate 26 has recesses 50 at positions corresponding to the indicator sections 42 and 43 so that the indicating sections 42 and 43 are pressed to the housing 22 by the recesses 50. Consequently, the LEDs 24 and 25 are firmly held in the side wall 30 of the housing 22.

When the modular plug (not shown) is plugged into the modular jack 21, the green indicating section 42 lights up, indicating that the modular jack 21 and the modular plug are electrically connected. While data is transmitted between the modular jack 21 and the modular plug, the yellow indicating section 43 flashes. When the engaging pieces 48 are brought into contact with a shield plate (not shown) of the modular plug, the shield plate 26 of the modular jack 21 is grounded.

Although different types of light emitting diodes can be used for the LEDs 24 and 25 in this embodiment, the same type of light emitting diodes may be used. Also, the LEDs 24 and 25 may be fixed to the grooves 33 and 34 by bonding or different ways other than the press-fitting.

In this embodiment, although the modular jack 21 is mounted on circuit board on the bottom surface, it may be mounted on the circuit board on the rear surface thereof. In the case, the lead sections 44 and 45 of the LEDs 24 and 25 extend straight and no bending work is required, which further reduces the manufacturing cost.

Both of the cavities 27 and 28 may be made to receive modular plugs for LAN. In this case, two pairs of LEDs are provided; one pair for each of the right-hand and left-hand side walls.

In addition, the coverage of the shield plate 26 is not limited to the above-mentioned area. For example, the shield plate may cover the lead sections 44 and 45 as well, or it may be omitted.

As described above, according to the invention, since the LED is fixed to the housing by inserting it into the groove, the fixing work for LED is simplified, no processing work for making grooves in LED is required, and an ordinary LED sold on the market can be used, which reduces the manufacturing cost.

Since the LEDs are provided in the side wall of the cavity, when the modular plug is inserted into the modular jack, the indicating section of the LED is not hidden by cables of the modular plug and clearly visible.

In addition, since the LED is accommodated in the side wall of the housing, the size of the modular jack in a horizontal direction is minimized, which enables to reduce the size of the modular jack.

What is claimed is:

1. A modular jack, comprising a housing having side walls;

a plurality of cavities provided at a front side of said housing, into which mating modular plugs are inserted, a plurality of grooves provided in one of said side walls in a vertical direction; and a plurality of light emitting diodes (LED) fitted into said grooves and accommodated in said one of said side walls, wherein each of said grooves includes a front section and an L-shaped rear section extending from said front section.

2. The modular jack according to claim 1, which further comprises a shield plate provided outside said housing so as to press said LED to said housing.

3. The modular jack according to claim 2, wherein said shield plate has at least one recess for pressing said LED to said housing.

4. The modular jack according to claim 1, wherein said groove has a holding section, in which said LED is press-fitted.

5. The modular jack according to claim 4, which further comprises a shield plate provided outside said housing so as to press said LED to said housing.

6. The modular jack according to claim 5, wherein said shield plate has at least one recess for pressing said LED to said housing.

* * * * *